US009991637B2

(12) United States Patent
Capucci et al.

(10) Patent No.: US 9,991,637 B2
(45) Date of Patent: Jun. 5, 2018

(54) LOCKING FASTENING DEVICE FOR TWO-PART ELECTRICAL CONNECTORS WITH AXIAL COUPLING

(71) Applicant: AMPHENOL-AIR LB, Carignan (FR)

(72) Inventors: Matthieu Capucci, Amblimont (FR); Anthony Wanschoor, Sedan (FR)

(73) Assignee: AMPHENOL-AIR LB, Carignan (FR)

( * ) Notice: Subject to any disclaimer, the term of this patent is extended or adjusted under 35 U.S.C. 154(b) by 0 days. days.

(21) Appl. No.: 15/637,915

(22) Filed: Jun. 29, 2017

(65) Prior Publication Data

US 2018/0006404 A1 Jan. 4, 2018

(30) Foreign Application Priority Data

Jun. 30, 2016 (FR) ..... 16 556238

(51) Int. Cl.

| | |
|---|---|
| ***H01R 13/627*** | (2006.01) |
| ***H01R 13/639*** | (2006.01) |
| *H01R 13/508* | (2006.01) |
| *H01R 13/622* | (2006.01) |

(52) U.S. Cl.

CPC ..... *H01R 13/6395* (2013.01); *H01R 13/627* (2013.01); *H01R 13/508* (2013.01); *H01R 13/622* (2013.01); *H01R 13/6273* (2013.01); *H01R 13/639* (2013.01)

(58) Field of Classification Search

CPC ..... H01R 13/639; H01R 13/6273

See application file for complete search history.

(56) References Cited

U.S. PATENT DOCUMENTS

| | | | | |
|---|---|---|---|---|
| 6,497,516 | B1 * | 12/2002 | Toyooka | G02B 6/3882 385/78 |
| 7,758,370 | B1 * | 7/2010 | Flaherty | H01R 13/6275 439/352 |
| 8,215,977 | B2 * | 7/2012 | Zapf | H01R 13/6273 439/352 |
| 8,562,372 | B2 * | 10/2013 | Sagdic | H01R 13/639 439/352 |
| 8,651,887 | B2 * | 2/2014 | Zhang | H01R 13/6275 439/352 |
| 2015/0037997 | A1 * | 2/2015 | McGivern | H01R 13/6273 439/352 |

FOREIGN PATENT DOCUMENTS

| | | |
|---|---|---|
| EP | 0 416 769 A1 | 3/1991 |
| EP | 2 571 113 A1 | 3/2013 |
| EP | 2 787 579 A1 | 10/2014 |
| FR | 2 849 967 A1 | 7/2004 |
| FR | 2 887 079 A1 | 12/2006 |
| WO | 2008/145516 A2 | 12/2008 |

* cited by examiner

*Primary Examiner* — Tho D Ta

(74) *Attorney, Agent, or Firm* — Andrew W. Chu; Craft Chu PLLC

(57) ABSTRACT

The locking fastening device for two-part electrical connectors with axial coupling includes two male mistake-proofing mechanisms and two female mistake-proofing mechanisms included in the parts. The mistake-proofing mechanisms are positioned on both sides of the contacts of the two parts of the male and female electrical connector and respectively includes at least a protuberance and a bore axially cooperative to produce the fastening of the parts, during coupling.

9 Claims, 2 Drawing Sheets

LOCKING FASTENING DEVICE FOR TWO-PART ELECTRICAL CONNECTORS WITH AXIAL COUPLING

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a locking fastening device for two-part electrical connectors with axial coupling. The technical field to which the invention relates therefore pertains first to connector technology, and more particularly pertains to the field of secure connections related to aeronautic and military applications.

2. Description of Related Art Including Information Disclosed Under 37 CFR 1.97 and 37 CFR 1.98

In these fields, the quality and sustainability of the connection implemented, in particular a primarily electrical connection, are crucial, and they first involve mechanical coupling characteristics. It is imperative for the fastening of the two parts of the connectors to be guaranteed, and for any untimely breaking to be prohibited and made practically impossible by the system. It should be noted that the connectors in question also perform a mistake-proofing function, which occurs upstream from the sustainability and securing function of the connection, and may appear less decisive, even though it also contributes to security: in any case, it prevents an electrical connection from being established between two incompatible male and female connectors, respectively, which could result in a poor signal transfer that could potentially be disastrous and in fine equally detrimental to security.

The connectors affected by the present invention are in particular those that obey the strict normative characteristics inherent to the aeronautics industry and military applications, the technical constraints of which are listed in standard EN3545 inter alia.

They involve, inter alia, the implementation of mechanical locking of the two parts of the connector when they are coupled and when the electrical connection is in place and functional. The aim is to eliminate any possibility of accidental disconnection, i.e., unexpected, unplanned and not done by human intervention.

It is consequently also the primary aim of the locking fastening device according to the present invention, the latter nevertheless greatly exceeding this aim inasmuch as it proposes innovations resulting certain drawbacks of the commercially available connectors and making the device very attractive from an industrial perspective.

Thus, in the known connectors, mistake-proofing is commonly associated with fastening of the parts of the connector by screwing, the applicable standards then requiring a monitoring measurement of the tightening torque. This is done by a dynamometric tool providing a precise indication of the measured torque, this tool continuously monopolizing one of the operator's hands. The performance time of the measurement obviously affects the assembly rhythms, imposing non-negligible installation and maintenance times, in particular in light of the number of connectors to be fastened or verified.

The appropriate tools for performing the tightening, such as dynamometric keys, use bushes suitable for the mechanical connection to be monitored, which are often lost when they accidentally detach from the rest of the tool. Yet in the aeronautic construction field in particular, it is absolutely essential to look for and find a bush that has become detached, since any risk of damage to the aircraft during flight due to this unruly mechanical part is unacceptable. The search, according to the configuration of the establishment site of the connection, may take time, which is also detrimental to assembly rhythms.

Furthermore, the quick analysis of the connections and their locking is in no way obvious with traditional screwed or clipped connectors, since the state of the connection is generally not immediately visible and the tightening torques are only rarely able to be viewed and, in the scenario of quarter-turn systems, the locking may have been done only partially without this being apparent. The monitoring of the exact condition of the connections therefore also requires a lengthy intervention time, and the time-related economic impact of which is unfavorable.

BRIEF SUMMARY OF THE INVENTION

The invention provides an effective technical solution to the raised questions, which is also particularly astute inasmuch as it is fully possible to carry it out in the housings of existing connectors, simply by substituting certain components, which in passing procures a substantial economic advantage.

As a reminder, the invention applies to two-part electrical connectors with axial coupling known in itself, i.e., including two male mistake-proofing mechanisms and two female mistake-proofing mechanisms included in said parts, these mistake-proofing mechanisms being positioned on both sides of the contacts of these connectors.

Traditionally, these male and female mistake-proofing mechanisms respectively comprise at least one protuberance and a bore able to cooperate axially to fasten the parts during coupling.

According to the design specific to the invention:

the protuberance of the male mistake-proofing mechanism includes at least one flexible element protruding from its surface abutting with the female mistake-proofing mechanism, able to be axially inserted into the bore of said female mistake-proofing mechanism and including at least one axial blocking member by radial expansion of the flexible element in said bore;

the bore of the female mistake-proofing mechanism includes an expansion space for the flexible element of the male mistake-proofing mechanism, provided with axial blocking means for the blocking member(s) of the male mistake-proofing mechanism;

a push-piece is associated with the female mistake-proofing mechanism, movable within the latter and including guide means between an inactive position without axial blocking and an active position with axial blocking of the two mistake-proofing mechanisms by insertion of the push-piece into the flexible element of the male mistake-proofing mechanism to push it back radially, guide means actuating locking means of the axial blocking.

This original design allowing guiding and locking resulting from the guiding eliminates the need to use a tool, of any kind, and allows the operator to perform the assembly/disassembly with one hand. Time savings and work comfort are thus greatly improved.

According to one possible configuration, the locking means of the push-piece include return means inserted between the female mistake-proofing mechanism and the push-piece stressing the push-piece in rotation, the guide means initiating the rotation actuating the locking of the push-piece in the female mistake-proofing mechanism.

This involves a system that can be qualified as self-locking inasmuch as the return means constantly tend to stress the push-piece in the locked position, and inasmuch as the handling of said push-piece in the direction of axial blocking of the mistake-proofing mechanisms automatically actuates said blocking due to the action of the guide means.

According to one possibility, said guide means of the push-piece in the female mistake-proofing mechanism can consist of radial studs, one cooperating with L-shaped housings of the other, performing a bayonet-type connection. This type of connection indeed involves a combination of a rectilinear movement and a rotating movement, in line with the logic set out above.

According to one configuration of the invention, the flexible element of the axial protuberance of the male mistake-proofing mechanism can consist of at least one axial flexible wall of the protuberance, said wall being provided at its free end with a rim protruding toward the outside of the protuberance. Said rim then forms the axial blocking member of the male mistake-proofing mechanism.

According to one possible configuration, the protuberance includes two flexible elements that consist of the wall of a hollow cylindrical barrel divided in two by axial slits formed up to the vicinity of the abutment surface of the male mistake-proofing mechanism at the female mistake-proofing mechanism. The barrel is then for example provided with an end collar, oriented radially toward the outside of the barrel and the outer diameter of which does not exceed that of the bore, the collar portions of the half-barrels making up the flexible elements forming the axial blocking members of the male mistake-proofing mechanism.

It will be noted that this does not involve the traditional clipping system, since the flexible element(s) are not stressed in flexion during the insertion of the protuberance in the bore, since, for example, the outer diameter of the collar is smaller than or equal to the inner diameter of the bore. The axial blocking comes from the expansion of said elements, caused in case of activation of the system by the axial movement of the push-piece, which moves the collar into the space provided to that end in the female mistake-proofing mechanism.

A solution consists of having at least one elastic element, in the case at hand the wall(s), that deforms with assembly is also possible and procures an additional function in that it allows pre-maintenance of the connector before locking.

In practice, the bore of the female mistake-proofing mechanism can for example include, to allow this expansion, a radial space widening its inner diameter and able to house the blocking member of each flexible element. This space can then have a projection situated at a distance from its abutment surface with the male mistake-proofing mechanism substantially equal to the distance separating the blocking members from the abutment surface of the male mistake-proofing mechanism. Once this distance is traveled during the insertion of the axial protuberance of the male mistake-proofing mechanism into the bore of the female mistake-proofing mechanism, the conditions for a potential expansion are met: this is done only during activation of the push-piece.

When the push-piece is actuated, i.e., when it is inserted inside the female mistake-proofing mechanism, the aforementioned bayonet guiding system is used. According to one possible configuration, a torsion spring is inserted between the female mistake-proofing mechanism and the push-piece, continuously stressing the push-piece in rotation. Studs protruding radially from the push-piece are further guided each in a notch formed in the inner wall of the female mistake-proofing mechanism. According to the invention, this notch for example has a locking flank provided with a first rectilinear portion emerging after a hard spot in a rounded portion that loops over a rounded unlocking flank ending with a second rectilinear portion across from the first.

The combined movement targeting the locking is ensured by the locking flank of the notch, the locking becoming effective after the passage past the threshold made up of the hard spot and the slight subsequent withdrawal of the push-piece into the rounded flank due to traditional axial return means of this type of connection, of the lock washer type. It should be noted that the elastic properties of seals inserted between the parts of the connectors also play a role in this respect.

Additionally, according to the invention, a device retaining the push-piece in the female mistake-proofing mechanism such as a ring equips the perimeter of the push-piece. This ring is movable for example in a cylindrical peripheral recess of the female mistake-proofing mechanism defined on one side by a rim in which the notches emerge, and on the other side by a shoulder situated at a distance from the rim adjacent to the axial length of said notches. The axial travel is therefore provided so that the assembly can be found on the one hand in the inactive disconnection position without the push-piece being free to detach from the female mistake-proofing mechanism, and on the other hand in the active axial and locked blocking position of the mistake-proofing mechanisms, and consequently of the two parts of the connector equipped with a device according to the invention.

According to one possible design, non-limiting with respect to the invention, the torsion spring can be positioned in an annular housing of the body of the push-piece, between a central cylindrical core whereof the free end is provided to push the flexible elements back and a low cylindrical peripheral wall. The branches of said spring are then for example housed one in an axial orifice of the female mistake-proofing mechanism and the other in an axial slit formed in the periphery of a low wall, as well as in the retaining ring housed in a peripheral recess of the body of the push-piece adjacent to the low wall, and lastly in the portion of said body adjacent to the other side of said recess and from which the studs protrude.

The torsion spring consequently indeed bears simultaneously on the female mistake-proofing mechanism, one of the walls of the axial orifice that receives one of the branches, and the push-piece, on a wall opposite—relative to the rotation—the slit described above.

BRIEF DESCRIPTION OF THE SEVERAL VIEWS OF THE DRAWINGS

The invention will now be described in more detail, in reference to the appended figures.

DETAILED DESCRIPTION OF THE INVENTION

Figure 3:
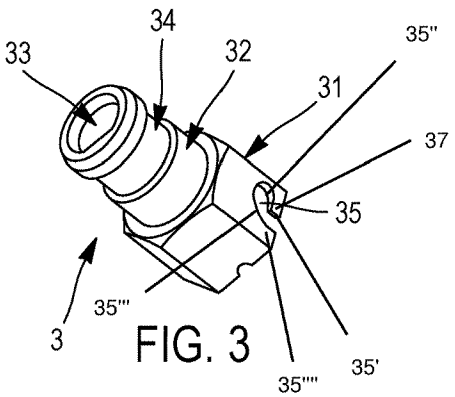
FIGS. 2 to 5 show perspective views of the different components of said connection device, namely, respectively, the male mistake-proofing mechanism (FIG. 2), the female mistake-proofing mechanism (FIG. 3), the push-piece (FIG. 4) and the torsion spring (FIG. 5).
Figure 5:
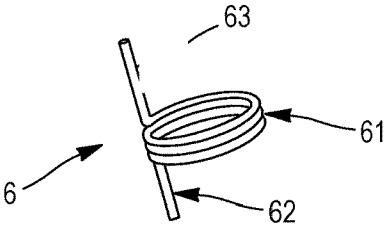
Figure 2:
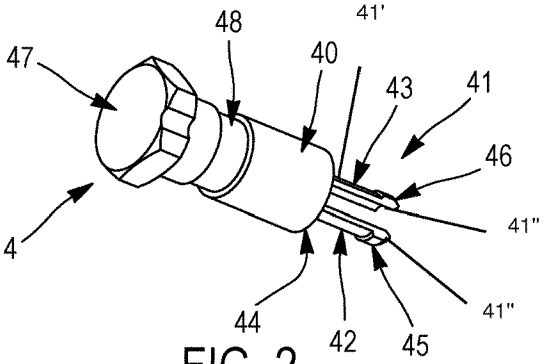
Figure 4:
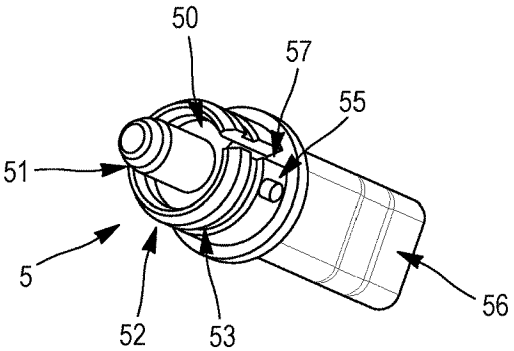

In reference to FIGS. 1 to 5, the device according to the invention applies to secure electrical connectors including a female part 1 provided with female mistake-proofing mechanisms or female connectors 3 (only one of which is visible in the partial view) and a male part 2 provided with male mistake-proofing mechanisms or male connectors 4 (only one of which is visible for the same reason). The male mistake-proofing mechanism 4 includes a cylindrical main body 40 from which a protuberance 41 made up of two flexible elements 42, 43 axially protrudes. In practice, the protuberance 41 is made up of a divided hollow barrel 41' in said flexible elements 42, 43 by the removal of two portions of the peripheral wall 41" of the barrel 41' up to the base of the latter, at the abutment surface 44 of the male mistake-proofing mechanism 4. At the free end of the flexible elements 42, 43, portions 45, 46 of an outer collar 41''' or rim of the barrel extend toward the outside of the latter, in a substantially radial direction. The mistake-proofing mechanism 4 also includes a hexagonal head 47 housed in a recess 21 with a corresponding shape of the male part 2 of the connector, preventing any relative rotation.

A ring 22 is positioned in a peripheral recess 48 of the mistake-proofing mechanism 4, for the axial retention of the latter in the part 2. Axial blocking also results from a nut 23 and a blocking washer 24.

The female mistake-proofing mechanism 3 includes a first hexagonal portion 31 that blocks its rotation in a housing 11 of the part 1 making up the female connector. The hollow barrel 32 includes an inner bore 33 and an annular recess 34 intended to receive an axial retaining ring 12 clipped on a shoulder 13 of the part 1. The hexagonal portion 31 of the mistake-proofing mechanism 3 also has L-shaped notches 35 for the bayonet-type connection, positioned opposite one another and only one of which is visible in FIG. 3. The notch 35 has locking flank formed by a first rectilinear portion 35', a hard spot 37, a rounded portion 35" that loops over the hard spot 37, a rounded unlocking flank 35''', and a second rectilinear portion 35'''' across from the first rectilinear portion 35'.

The push-piece 5 includes a cylindrical core 51, defining, with a low peripheral wall 52, a housing 50 for the spiral body 61 of the spring 6. The push-piece 5 also includes a peripheral annular recess 53 for the retaining ring 54. Only one stud 55 from among the two situated opposite one another is visible in FIG. 4, said studs 55 being provided to cooperate with the notches 35 of the female mistake-proofing mechanism 3, in the bayonet guiding connection. A gripping handle 56 allows manipulation by the operator, which therefore does not require any tools. An axial slit 57 is used to house one of the branches 62, 63 of the torsion spring 6.

Figure 1:
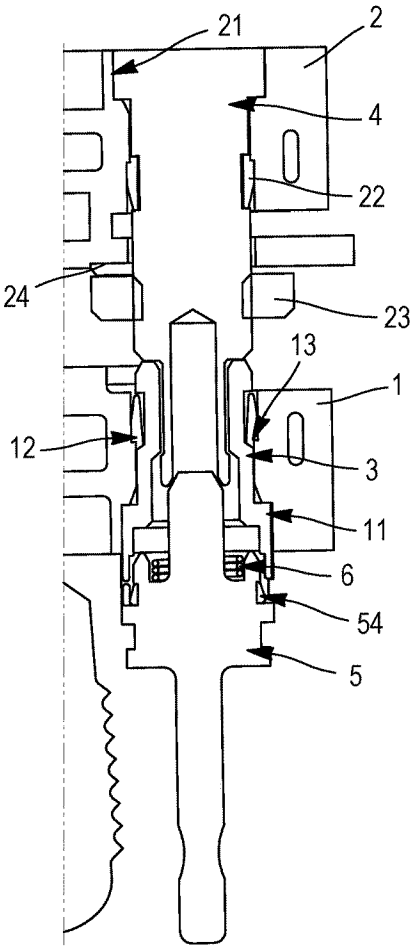
FIG. 1 is a partial axial sectional view of a connection device according to the invention.
Figure 7:
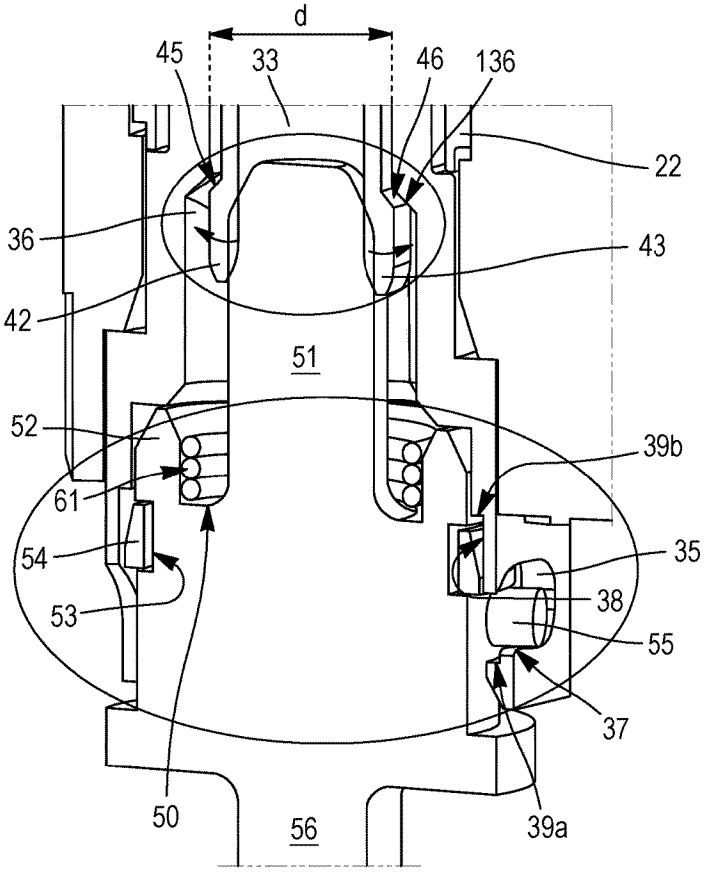
FIG. 7 shows another enlarged sectional view equivalent to FIG. 6, showing the interaction between the mistake-proofing mechanisms in the blocked and locked position.
Figure 6:
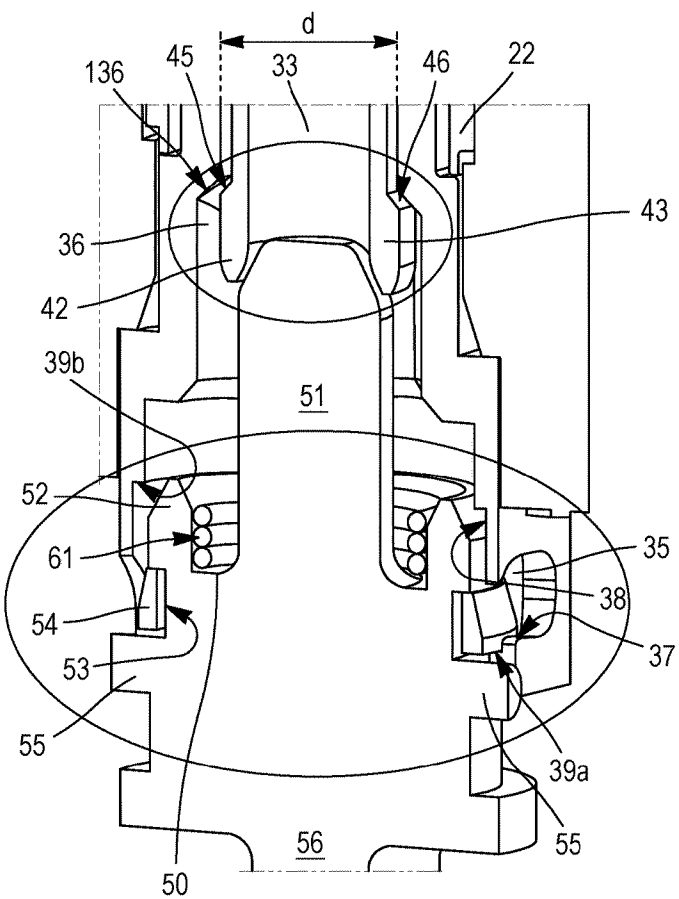
FIG. 6 is an enlarged sectional view of the interaction between the mistake-proofing mechanisms in the non-blocked and unlocked position.

In the state of FIG. 1, the connection is not finalized, it is not axially blocked or locked, it is in the same state as in FIG. 6, i.e., with the hub 51 of the push-piece located near the flexible elements 42, 43 of the male mistake-proofing mechanism 4. In FIGS. 6 and 7, the small circle corresponds to the axial blocking zone, and the large circle corresponds to the locking zone in the blocked position. The state of the connection is intermediate, one is in the presence of an activated state that has begun, an axial thrust of the push-piece 5 already having been initiated.

First examining the zone shown by the small circle in FIG. 6, the outer collar 45, 46 of the flexible elements 42, 43 is not yet pushed radially into the expansion space 36 provided in the female mistake-proofing mechanism 3. As shown, in this inactivated state, because the outer diameter of these collars 45, 46 is not larger than the inner diameter d of the bore 33, no axial blocking is yet possible.

In the lower part "covered" by the large circle, the studs 55 are already engaged in a rectilinear portion of the notches 35, below the hard spots 37 marking the directional change of the push-piece 5. The latter is indeed stressed in rotation as of the beginning of the movement by the torsion spring 6, which is compressed between the slit 57 of the push-piece 5 and an orifice (not shown) inside the female mistake-proofing mechanism 3, but it cannot rotate when it is upstream from the hard spots 37. The ring 54 does not oppose the movement, it is movable in a cylindrical peripheral recess 38 of the female mistake-proofing mechanism 3 closed by a rim **39*a* in which the slots 35 emerge, and limited in the upper part by a shoulder 39*b*. The distance between them is close to the axial length of the slots 35, which guarantees that when the device is deactivated, the push-piece 5 is retained such that the studs 55 are ready to be activated, and are situated at the inlet of the notches 35, thereby allowing the accumulation of energy in the spring. 6. In the unlocking phase, which involves the excursion of the push-piece 5 furthest from the inside of the female mistake-proofing mechanism 3, the stop formed by the shoulder 39*b* does not oppose the upward movement of the ring 54**.

In reference to FIG. 7, the connection is activated, i.e., the parts 1 and 2 of the connector are axially blocked and locked. The movement in the axial direction of the push-piece 5 in the female mistake-proofing mechanism 3 triggers the self-locking in the manner explained below. In reference to the zone covered by the small circle, more particularly related to the axial blocking function, the latter results from the fact that the core 51 of the push-piece 5 has moved axially enough to separate the flexible elements 42, 43 such that the collar portions 45, 46 are now in the space 36, with a facing surface of a projection 136 of the expansion space 36 that prevents any axial withdrawal of one of the parts 1, 2 relative to the other 2, 1.

At the same time, the studs 55 having arrived at the hard spots 37, the push-piece 5 is rotated by the spring 6, which releases its energy at the entry for the studs 55 in the non-rectilinear portions of the slots 35. Past the hard spots 37, said studs descend again slightly into the rounded part of the openings, locking the connection by releasing axial energy, for example, by an elastic seal inserted between the two parts 1, 2 of the connector according to the invention. The unlocking is done very simply by reverse rotation and pulling of the push-piece is (to block the latter in the non-locking zone) by the operator.

The configuration described in reference to the figures is of course not exhaustive with respect to the invention, which on the contrary encompasses the shape and structure alternatives that relate to the various components and organize the same functions, inasmuch as they fall within the definition of the claims.

We claim:

1. A locking fastening device for two-part electrical connectors with axial coupling, the device comprising:

a male connector being comprised of a cylindrical main body having an abutment surface and a protuberance extending from said cylindrical main body, said protuberance being comprised of at least one flexible element protruding from said abutment surface, each flexible element having an axial blocking member radially extending outward;

a female connector being comprised of hollow barrel with an annular recess, an inner bore, and a surface projection between said inner bore and said annular recess, wherein said male connector and said female connector form an intermediate connected configuration, when said at least one flexible element of said male connector inserts through said inner bore of said female connector, and a corresponding axial blocking member abuts said surface projection, said male connector and said female connector being axially aligned; and a push-piece being comprised of a means for guiding said male connector and said female connector from said intermediate connected configuration to an active axial locked configuration, wherein said push-piece inserts through said female connector to push said at least one flexible element of said male connector radially outward into an expansion space formed by said surface projection and said annular recess in said active axial locked configuration, said male connector and said female connector being axially aligned and axially locked to each other in said active axial locked configuration.

2. The locking fastening device for electrical connectors, according to claim 1, wherein said push-piece 5 further comprises a cylindrical core, and wherein said means for guiding said male connector and said female connector from said intermediate connected configuration to an active axial locked configuration comprises a housing, a peripheral wall, at least one stud extending outward from said peripheral wall, a notch in said female connector corresponding to each stud, and a means for returning said at least one stud in and out of a corresponding notch by rotation of said push-piece.

3. The locking fastening device for electrical connectors, according to claim 2, wherein said means for guiding said male connector and said female connector from said intermediate connected configuration to an active axial locked configuration comprises a plurality of studs radially arranged around said housing, wherein said notch in said female connector corresponding to each stud has an L-shape, and wherein each stud and correspond notch are in bayonet connection in said active axial locked configuration.

4. The locking fastening device for electrical connectors, according to claim 1, wherein said protuberance of said male connector is comprised of a hollow barrel having at least one portion of axial flexible peripheral wall with a free end, said axial blocking member being comprised of an outer collar at said free end of said at least one portion of axial peripheral wall.

5. The locking fastening device for electrical connectors, according to claim 4, wherein said hollow barrel is comprised of two portions of axial flexible peripheral wall, wherein said outer collar is oriented radially outward and has an outer diameter less than a diameter of said inner bore of said female connector.

6. The locking fastening device for electrical connectors, according to claim 1, wherein said at least one flexible element has a length corresponding to a length of said inner bore of said female connector, said corresponding axial blocking member abutting said surface projection in said annular recess for said intermediate connected configuration and in said expansion space for said active axial locked configuration.

7. The locking fastening device for electrical connectors, according to claim 3, wherein said means for returning said at least one stud in and out of a corresponding notch by rotation of said push-piece is comprised of a torsion spring inserted between said female connector and said push-piece, said torsion spring exerting pressure to rotate said push-piece so as to engage said studs each notch in said female corresponding to each stud, each notch having a first rectilinear portion, a hard spot, a rounded portion looping over said hard spot, a rounded unlocking flank, and a second rectilinear portion across from said first rectilinear portion.

8. The locking fastening device for electrical connectors, according to claim 7, wherein said means for guiding said male connector and said female connector from said intermediate connected configuration to an active axial locked configuration further comprises a ring around said push-piece, wherein said female connector is further comprised of a cylindrical peripheral recess having a rim facing said push-piece and a shoulder facing said male connector, and wherein said ring engages said cylindrical peripheral recess so as to align each stud with said corresponding notch in said intermediate connected configuration.

9. The locking fastening device for electrical connectors, according to claim 8, wherein said torsion spring is comprised of a spiral body, one branch at an end of said spiral body and another branch at an opposite end of said spiral body, said torsion spring being positioned in said housing of said push-piece between said cylindrical core and said peripheral wall, wherein said peripheral wall has an axial slit, said one branch being housed in said axial slit and said ring of said push piece, wherein said another branch is housed in said female connector, and wherein said peripheral wall and said cylindrical core form a recess, at least a portion of said spiral body being housed in said recess, each stud extending from said peripheral wall on a side opposite said recess.

* * * * *